US012429041B2

(12) United States Patent
Yoshida

(10) Patent No.: US 12,429,041 B2
(45) Date of Patent: Sep. 30, 2025

(54) DIAPHRAGM PUMP AND LIQUID DISCHARGE APPARATUS INCLUDING DIAPHRAGM PUMP

(71) Applicant: CANON KABUSHIKI KAISHA, Tokyo (JP)

(72) Inventor: Kazuyuki Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 18/348,260

(22) Filed: Jul. 6, 2023

(65) Prior Publication Data

US 2024/0035464 A1 Feb. 1, 2024

(30) Foreign Application Priority Data

Jul. 28, 2022 (JP) ..... 2022-120157

(51) Int. Cl.
*F04B 43/04* (2006.01)
*F04B 43/02* (2006.01)

(52) U.S. Cl.
CPC ..... *F04B 43/046* (2013.01); *F04B 43/023* (2013.01)

(58) Field of Classification Search
CPC ..... F04B 23/06; F04B 43/023; F04B 43/026; F04B 43/046; F04B 45/041; H10N 30/05; H10N 30/50
See application file for complete search history.

(56) References Cited

U.S. PATENT DOCUMENTS

2011/0070110 A1* 3/2011 Hirata ..... F04B 43/043 417/413.2
2019/0192017 A1* 6/2019 Susi ..... A61B 5/02141
2020/0101744 A1* 4/2020 Abe ..... B41J 2/17509
2021/0324844 A1* 10/2021 Tanaka ..... F04B 45/041

FOREIGN PATENT DOCUMENTS

JP 2019112992 A 7/2019

* cited by examiner

*Primary Examiner* — Kenneth J Hansen
(74) *Attorney, Agent, or Firm* — Canon U.S.A., Inc. IP Division

(57) ABSTRACT

A diaphragm pump includes an actuator, a diaphragm, and first and second pump chambers and deforms to change a volume of the first pump chamber and a volume of the second pump chamber so that fluid flows. The diaphragm is bonded to a first surface and a second surface of the actuator. When the diaphragm is displaced convexly in a direction to the first pump chamber, the second pump chamber is configured to expand and the first pump chamber is configured to contract so that fluid flows into the second pump chamber and fluid flows out of the first pump chamber. When the diaphragm is displaced convexly in a direction to the second pump chamber, the first pump chamber is configured to expand and the second pump chamber is configured to contract so that fluid flows into the first pump chamber and fluid flows out of the second pump chamber.

15 Claims, 15 Drawing Sheets

DIAPHRAGM PUMP AND LIQUID DISCHARGE APPARATUS INCLUDING DIAPHRAGM PUMP

BACKGROUND

Field

The present disclosure relates to a diaphragm pump and a liquid discharge apparatus including the diaphragm pump.

Description of the Related Art

In a technical field of supplying ink to a print apparatus and the like, a small pump is used that pumps liquid in a fixed amount with high accuracy. A so-called diaphragm pump is known as such a small pump.

The diaphragm pump typically includes an actuator that converts input energy to physical motion, a diaphragm that deforms along with deformation of the actuator, and a pump chamber that deforms along with deformation of the diaphragm. The pump chamber continuously repeats expansion and contraction in volume in the diaphragm pump. Because pressure in the pump chamber decreases or increases at this time, an inflow of fluid from the outside of the diaphragm pump to the pump chamber and an outflow of fluid to the outside of the diaphragm pump are repeated. In the diaphragm pump, a check valve is arranged in each of an inlet port through which fluid flows into the pump chamber and an outlet port through which fluid flows out of the pump chamber to form a one-way flow. Repeated operation of a diaphragm in this state enables imbibition and discharge of fluid as a pump.

Considering one cycle, discharge of fluid from the diaphragm pump is stopped at the time of imbibition of fluid, and imbibition of fluid to the diaphragm pump is stopped at the time of discharge of fluid. For this reason, there is an issue that pulsation occurs in fluid to be supplied from the diaphragm pump.

Japanese Patent Application Laid-Open No. 2019-112992 discusses a diaphragm pump in which the inside of a pump chamber is sectioned into a main pump chamber and a sub-pump chamber, and the respective chambers are fluctuated by a main actuator and a sub-actuator, whereby fluid is uniformly supplied.

Because an actuator needs to be arranged in each of the main pump chamber and the sub-pump chamber in the diaphragm pump described in Japanese Patent Application Laid-Open No. 2019-112992, an apparatus becomes more complex and increases in cost.

SUMMARY

The present disclosure is directed to provision of a diaphragm pump that reduces pulsation of fluid to be supplied with a relatively simple configuration and a liquid discharge apparatus including the diaphragm pump.

According to an aspect of the present disclosure, a diaphragm pump includes an actuator including a first surface and a second surface that is a back surface of the first surface, a diaphragm bonded to the first surface and the second surface, a first pump chamber that faces the diaphragm, and that is formed on a side of the first surface, and a second pump chamber that faces the diaphragm, and that is formed on a side of the second surface, wherein the diaphragm pump is configured to deform to change a volume of the first pump chamber and a volume of the second pump chamber so that fluid flows, wherein, when the diaphragm is displaced convexly in a direction to the first pump chamber, the second pump chamber is configured to expand and the first pump chamber is configured to contract so that fluid flows into the second pump chamber and fluid flows out of the first pump chamber, and wherein, when the diaphragm is displaced convexly in a direction to the second pump chamber, the first pump chamber is configured to expand and the second pump chamber is configured to contract so that fluid flows into the first pump chamber and fluid flows out of the second pump chamber.

Further features of the present disclosure will become apparent from the following description of exemplary embodiments with reference to the attached drawings.

DESCRIPTION OF THE EMBODIMENTS

Exemplary embodiments of the present disclosure will be described with reference to the drawings. The following exemplary embodiments do not limit matters of the present disclosure, and all combinations of features described in the exemplary embodiments are not necessarily essential for the present disclosure. An identical component is denoted by an identical reference number.

Figure 1:
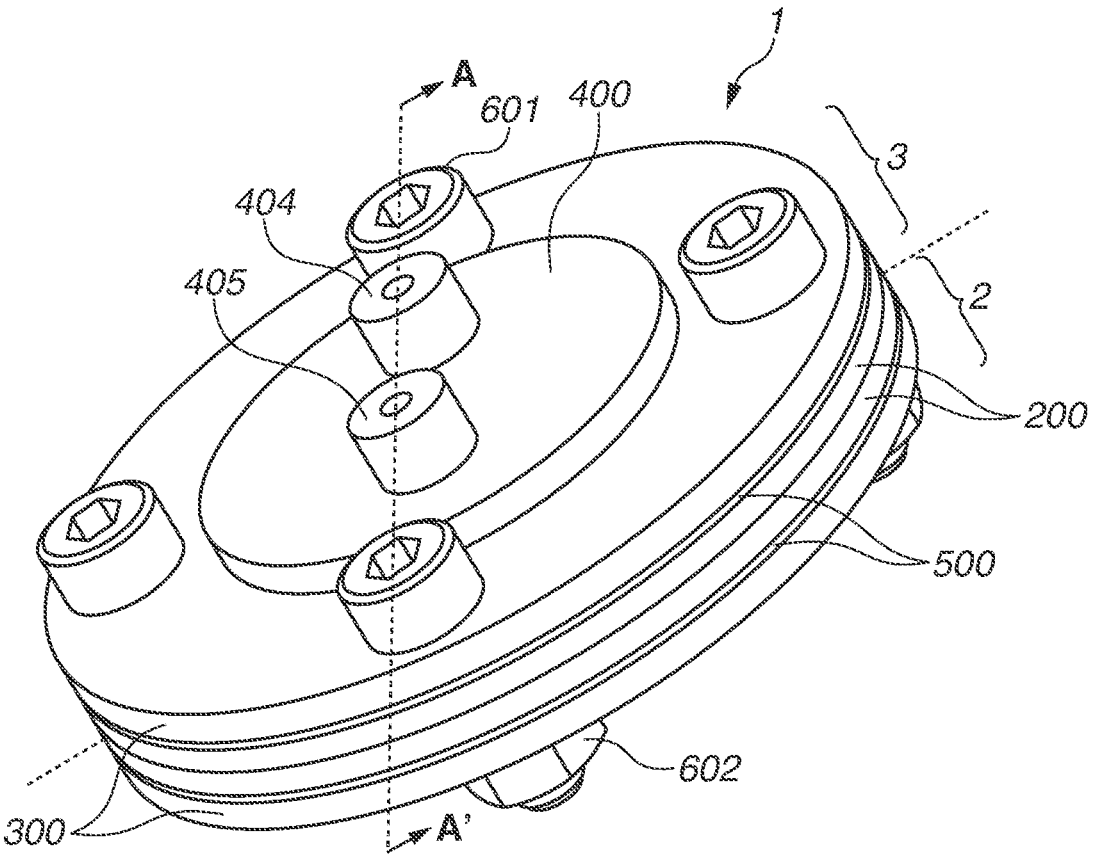
FIG. 1 is an outer appearance perspective view of a diaphragm pump.
Figure 2:
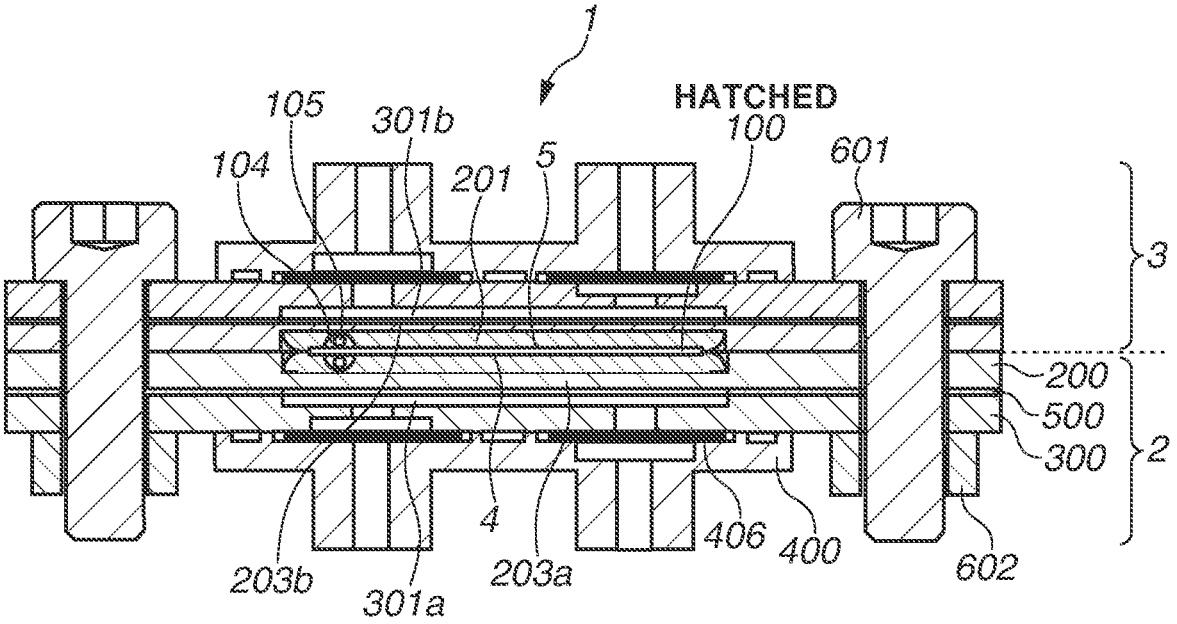
FIG. 2 is a cross-sectional view along an A-A' line in FIG. 1.

A first exemplary embodiment is now to be described. FIG. 1 is an outer appearance perspective view of a diaphragm pump 1 according to the exemplary embodiment of the present disclosure. FIG. 2 is a cross-sectional view along an A-A' line that is illustrated in FIG. 1 and that passes through the center of the diaphragm pump 1. The diaphragm pump 1 includes an actuator 100 including a first surface 4 and a second surface 5 that is the back surface of the first surface 4. The actuator 100 converts input energy to physical motion. A first pump 2 is arranged on the actuator 100 on a side of the first surface 4, and a second pump 3 is arranged on the actuator 100 on a side of the second surface 5. The first pump 2 and the second pump 3 are fastened with a fastening bolt 601 and a fastening nut 602 so as to interpose the actuator 100 therebetween.

A first diaphragm 203*a* is bonded to the first surface 4 of the actuator 100, and a second diaphragm 203*b* is bonded to the second surface 5 of the actuator 100. In the present exemplary embodiment, the first diaphragm 203*a* and the second diaphragm 203*b* are different devices, but may be integrated with each other so as to cover the first surface 4 and second surface 5 of the actuator 100.

In the present exemplary embodiment, the first pump 2 and the second pump 3 have substantially similar configurations except that the first diaphragm 203*a* and the second diaphragm 203*b* are different in thickness. That is, the present exemplary embodiment has such a configuration as that one diaphragm pump and another diaphragm pump that is rotated by 180° are arranged so as to interpose the actuator 100 therebetween. In this manner, in the present disclosure, one actuator 100 is arranged with respect to two diaphragm pumps, and the diaphragm pumps are bonded and fixed to upper and lower surfaces of the actuator 100, respectively.

Figure 3:
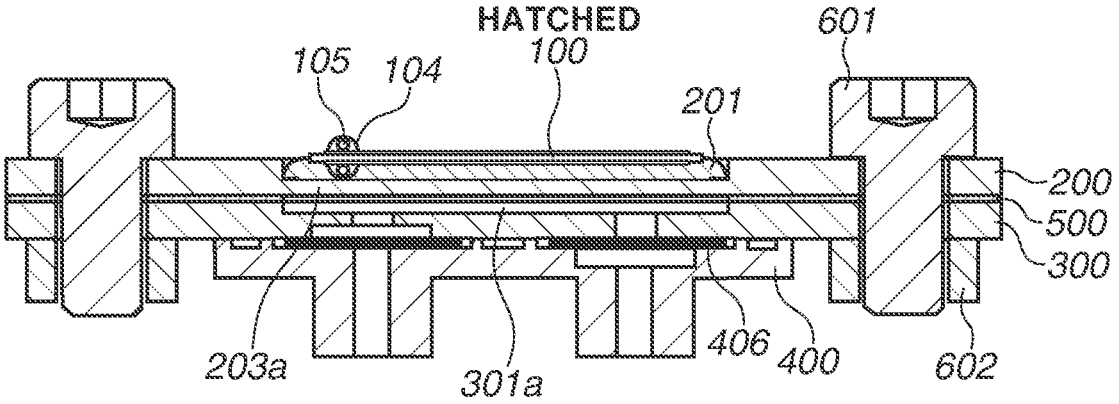
FIG. 3 is a cross-sectional view illustrating a first pump alone.
Figure 4:
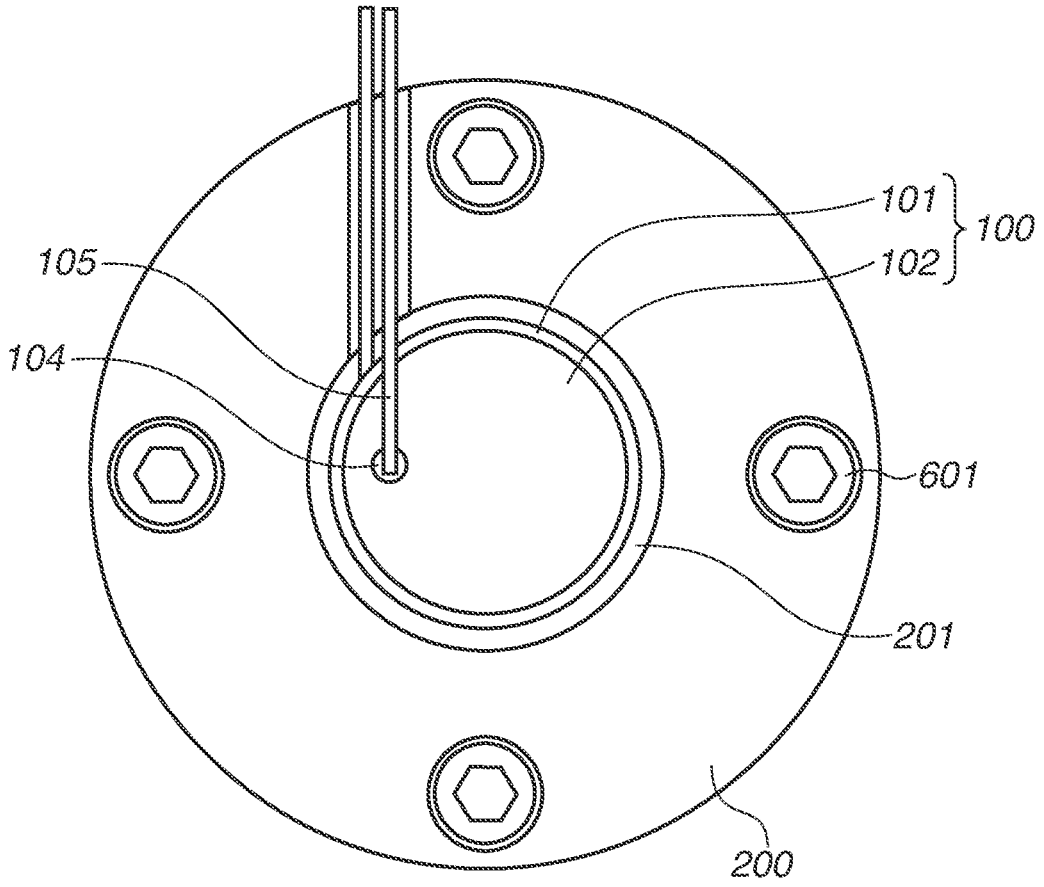
FIG. 4 is a top view illustrating the first pump alone.
Figure 5:
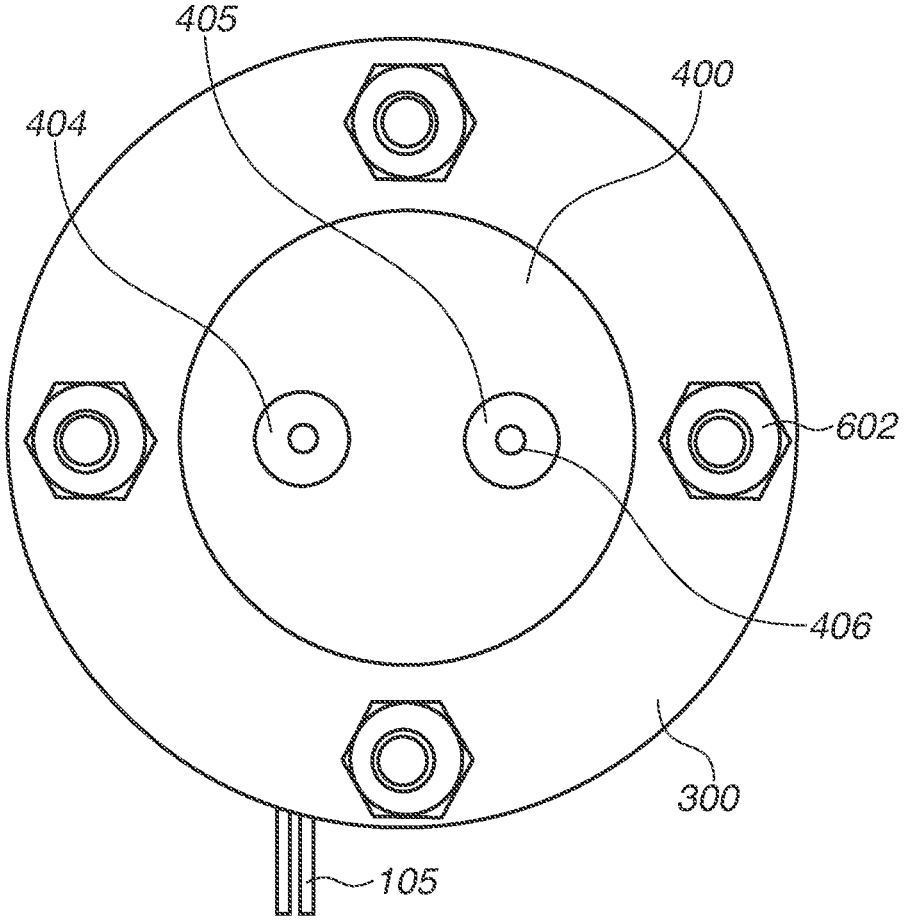
FIG. 5 is a bottom view illustrating the first pump alone.
Figure 6:
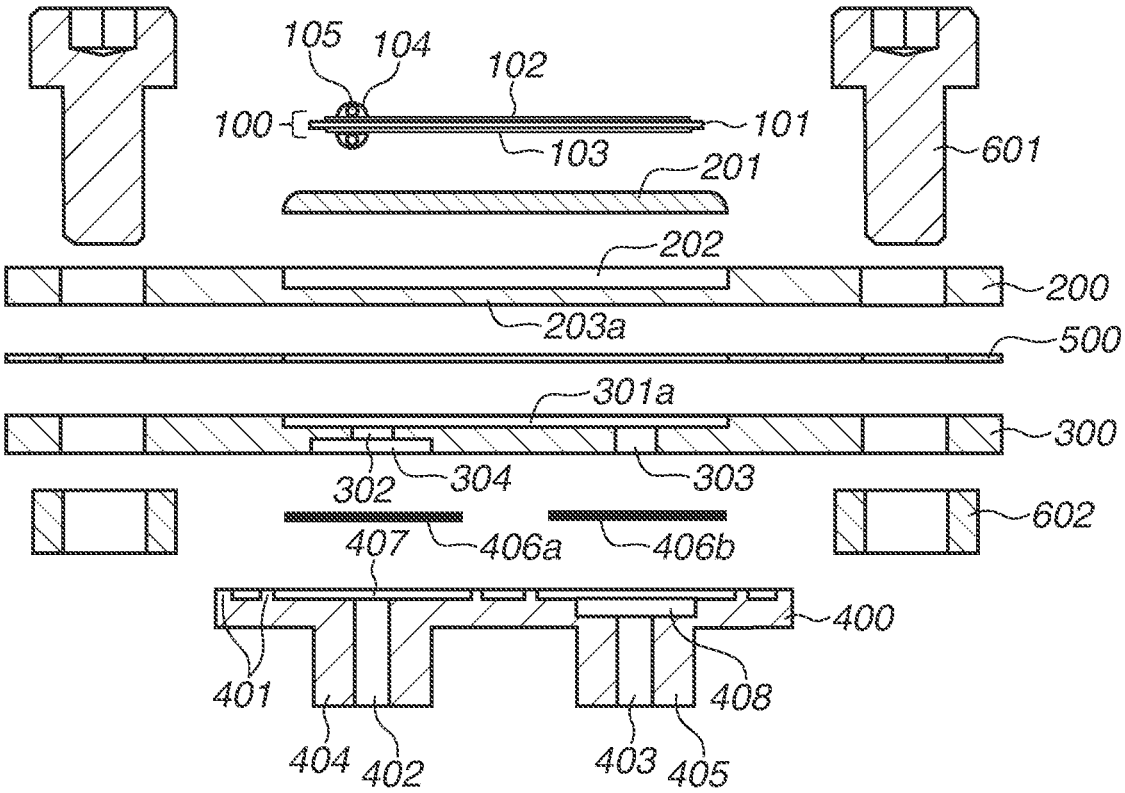
FIG. 6 is an exploded view illustrating the first pump alone.

A configuration of a single diaphragm pump is now to be described, taking the first pump 2 as an example. FIG. 3 is a cross-sectional view illustrating the first pump 2 alone. FIG. 4 is a top view illustrating the first pump 2 alone. FIG. 5 is a bottom view illustrating the first pump 2 alone. FIG. 6 is an exploded view illustrating the first pump 2 alone.

The first pump 2 is connected to the actuator 100, and mainly includes a diaphragm body 200, a pump body 300, and a joint body 400. A configuration of each component is to be described in detail below.

(Configuration of Actuator)

In the present exemplary embodiment, a description is given using an example of a piezoelectric actuator as the actuator 100, but the actuator 100 is not limited to the example and is only required to be capable of converting input energy to physical motion. In the actuator 100, an upper electrode 102 and a lower electrode 103 are formed on a piezoelectric element 101. Wiring 105 is connected onto the upper electrode 102 and the lower electrode 103 via solder 104. The wiring 105 is connected to a control unit, which is not illustrated, and a voltage at a predetermined frequency is applied to the piezoelectric element 101 by the control unit via the upper electrode 102 and the lower electrode 103. With this application of the voltage, the piezoelectric element 101 expands and contracts. In the present exemplary embodiment, the upper electrode 102 and the lower electrode 103 are formed of silver paste, and a thickness of each of the upper electrode 102 and the lower electrode 103 is about several micrometers. However, the upper electrode 102 and the lower electrode 103 are not limited to the example, and are only required to provide a potential difference to the piezoelectric actuator.

The actuator 100 is fixed to the diaphragm body 200 via an adhesive 201. An adhesion groove 202 to be filled with the adhesive 201 is formed in the diaphragm body 200. After the adhesion groove 202 is filled with the adhesive 201, the actuator 100 is pushed into the adhesion groove 202 so that the actuator 100 is bonded to the diaphragm body 200. At this time, because the solder 104 is formed on the upper and lower surfaces of the actuator 100, the adhesive 201 needs to have such a thickness as to cover the solder 104. In the present exemplary embodiment, the thickness of the adhesive 201 is about 0.7 mm, and an epoxy resin is used as an adhesive material. The adhesive 201 is not limited to the epoxy resin, and any adhesive that is capable of fixing the actuator 100 and the diaphragm body 200 may be used.

(Configuration of Diaphragm Body)

In the present exemplary embodiment, the diaphragm body 200 is formed by injection molding of a resin. The adhesion groove 202 to be filled with the adhesive 201 is formed in one surface of the diaphragm body 200 in contact with the actuator 100. In the diaphragm body 200, a bottom surface of the adhesion groove 202 has a small thickness, and this portion functions as the first diaphragm 203*a*. A diaphragm is a vibration film that deforms (vibrates) along with vibration of the actuator 100 and that is used for expanding or contracting a volume of a pump chamber. The diaphragm may be formed of either a single layer or multiple layers.

The first diaphragm 203*a* arranged on the first surface 4 of the actuator 100 and the second diaphragm 203*b* arranged on the second surface 5 of the actuator 100 are different in thickness. In a case where the thickness of the first diaphragm 203*a* and that of the second diaphragm 203*b* are different from each other, there occurs a difference in stiffness between the first diaphragm 203*a* and the second diaphragm 203*b*. This difference in stiffness allows the diaphragm to curve in a predetermined direction when the piezoelectric element 101 expands/contracts. Details will be described below. In the present exemplary embodiment, the thickness of the first diaphragm 203*a* and that of the second diaphragm 203*b* are 0.5 mm and 0.3 mm, respectively.

For a similar reason, even in a case where the first diaphragm 203*a* and the second diaphragm 203*b* are not different devices but are integrated with each other, it is preferable that there is a difference in stiffness between the first diaphragm 203*a* bonded to the first surface 4 and the second diaphragm 203*b* bonded to the second surface 5.

(Configuration of Pump Body)

In the present exemplary embodiment, the pump body 300 is formed by injection molding of a resin. The pump body 300 includes a pump chamber 301*a* that faces the diaphragm, and that is formed on a side of the first surface 4 of the actuator 100. The pump chamber 301*a* is also referred to as a first pump chamber. In the second pump 3, the pump body 300 includes a pump chamber 301*b* that faces the diaphragm, and that is formed on a side of the second surface 5 of the actuator 100. The pump chamber 301*b* is also referred to as a second pump chamber. The diaphragm and each of the first pump chamber 301*a* and the second pump chamber 301*b* need not directly face each other, and are only required to have such a configuration as to transmit vibration caused by displacement of the diaphragm to the first pump 2 and the second pump 3. For example, a film may be arranged between the diaphragm and each of the first pump chamber 301*a* and the second pump chamber 301*b*.

A rubber sheet 500 is arranged between the pump body 300 and the diaphragm body 200, and the pump body 300 and the diaphragm body 200 are fastened with the fastening bolt 601 and the fastening nut 602, so that the first pump chamber 301*a* is formed.

As a channel connected to the first pump chamber 301*a*, a pump body inlet port channel 302 and a pump body outlet port channel 303 are formed so as to penetrate the pump body 300. A surface of the pump body 300 on the opposite side of the surface in which the first pump chamber 301*a* is formed is connected to the joint body 400. An inlet port check valve opening/closing portion 304 that enables a check valve 406*a* to open/close is formed on this surface of the pump body 300. In the present exemplary embodiment, the pump body 300 and the joint body 400 are connected to each other using laser welding. Hence, the pump body 300 is preferably formed of a material through which laser light transmits.

(Configuration of Joint Body)

In the present exemplary embodiment, the joint body 400 is formed by injection molding of a resin. The joint body 400 is connected to the pump body 300 by laser welding. Hence, a welding rib 401 for welding is formed on the surface of the joint body 400 in contact with the pump body 300. The joint body 400 is connected to the pump body 300 by laser welding, so that an internal sealing property is maintained. Because the joint body 400 is connected to the pump body 300 by welding, the joint body 400 is preferably formed of a material that absorbs laser light. An inlet port connection portion 404 and an outlet port connection portion 405 to connect pipes or the like are formed on the surface of the joint body 400 on the opposite side of the pump body 300.

In the joint body 400, a joint body inlet port channel 402 and a joint body outlet port channel 403 that penetrate the joint body 400 are formed so as to communicate with the pump body inlet port channel 302 and the pump body outlet port channel 303 serving as a fluid channel, respectively. A check valve arrangement groove 407 for arranging the check valve 406*a* on a side of the inlet port channel and arranging a check valve 406*b* on a side of the outlet port channel is formed on one surface of the joint body 400 in contact with the pump body 300. Furthermore, an outlet port check valve opening/closing portion 408 is formed on a side of the joint body outlet port channel 403. The inlet port check valve opening/closing portion 304 is formed in the pump body 300, so that the check valve 406*a* is configured to open only toward a side of the inlet port check valve opening/closing portion 304. In contrast, the outlet port check valve opening/closing portion 408 is formed in the joint body 400, so that the check valve 406*b* is configured to open only toward a side of the outlet port check valve opening/closing portion 408.

A portion through which fluid flows into the first pump chamber 301*a*, that is, the pump body inlet port channel 302, the inlet port check valve opening/closing portion 304, the check valve arrangement groove 407, and the joint body inlet port channel 402 are collectively referred to as a first inlet port. A portion through which fluid flows out of the first pump chamber 301*a*, that is, the pump body outlet port channel 303, the check valve arrangement groove 407, the outlet port check valve opening/closing portion 408, and the joint body outlet port channel 403 are collectively referred to as a first outlet port. The first inlet port and the first outlet port do not necessarily include all of the components, and the portion through which fluid flows into the first pump chamber and the portion through which fluid flows out of the first pump chamber are referred to as the first inlet port and the first outlet port, respectively. The check valve 406*a* that opens/closes the first inlet port is also referred to as a first check valve, and the check valve 406*b* that opens/closes the first outlet port is also referred to as a second check valve.

The same applies to the second pump 3. A portion through which fluid flows into the second pump chamber 301*b* is referred to as a second inlet port, and a portion through which fluid flows out of the second pump chamber 301*b* is referred to as a second outlet port. A check valve that opens/closes the second inlet port is referred to as a third check valve, and a check valve that opens/closes the second outlet port is referred to as a fourth check valve. The fluid flow in the first and second inlet ports and the first and second outlet ports and operations of the respective check valves will be described in detail below.

(Arrangement of First and Second Pumps)

According to the present exemplary embodiment, the second pump 3 having a configuration that is substantially similar to that of the first pump 2 is arranged in a state where the second pump 3 is rotated by 180° across the actuator 100. In other words, the first inlet port and the second outlet port are formed to face each other across the actuator 100, and the first outlet port and the second inlet port are formed at respective positions so as to face each other across the actuator 100. That is, the first pump 2 and the second pump 3 share the actuator 100. The first pump 2 is formed by fixing the diaphragm body 200 to the actuator 100 on a side of the lower electrode 103 via the adhesive 201. Similarly, the second pump 3 is formed by fixing the diaphragm body 200 to the actuator 100 on a side of the upper electrode 102 via the adhesive 201. An identical adhesive material is used as the adhesive 201 that is used for fixing the first pump 2 and the second pump 3.

As a fixing method, first, the actuator 100 is bonded and fixed to the diaphragm body 200 on a side of the first pump 2, the adhesion groove 202 is filled with the adhesive 201 on a side of the second pump 3, the actuator 100 is flipped over, and then the diaphragm body 200 is pushed against the actuator 100. At this time, the actuator 100 is fixed while the positions of the upper part and the lower part of the diaphragm body 200 are controlled so as not to be misaligned from the outside. When the diaphragm body 200 of the second pump 3 is fixed to the actuator 100, the rubber sheet 500, the pump body 300, and the joint body 400 are arranged in a reversed manner with respect to those of the first pump 2. At this time, the pump body 300 and the joint body 400 are fixed using laser welding in a state where the check valves are encapsulated inside the pump body 300 and the joint body 400. Finally, the fastening bolt 601 is caused to penetrate each portion, and fastening is performed from the opposite side using the fastening nut 602. As illustrated in FIG. 4, four fastening bolts 601 are arranged on the circumference of a circle. When fastening degrees of the fastening bolts 601 are different, the whole of the diaphragm pump 1 is deflected, and intrinsic pump performance cannot be exerted. For this reason, fastening force of the fastening bolt 601 needs to be managed using a torque wrench, which is not illustrated.

(Description About Operations of First and Second Pumps)

Figure 7A:
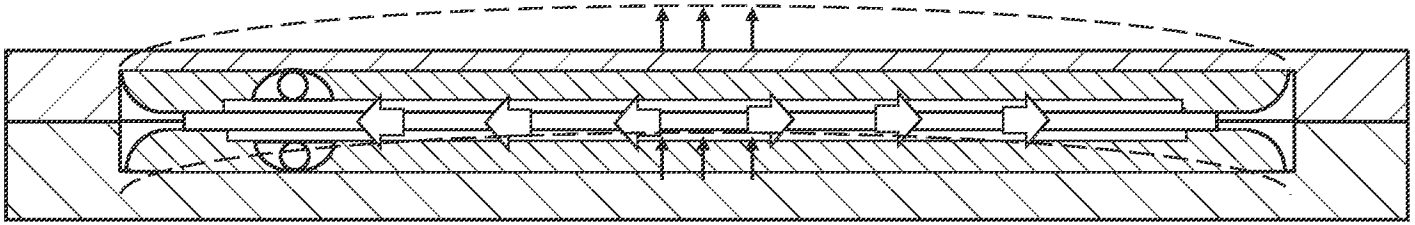
FIG. 7A is a schematic diagram illustrating behavior of a diaphragm when a piezoelectric element expands.
Figure 7B:
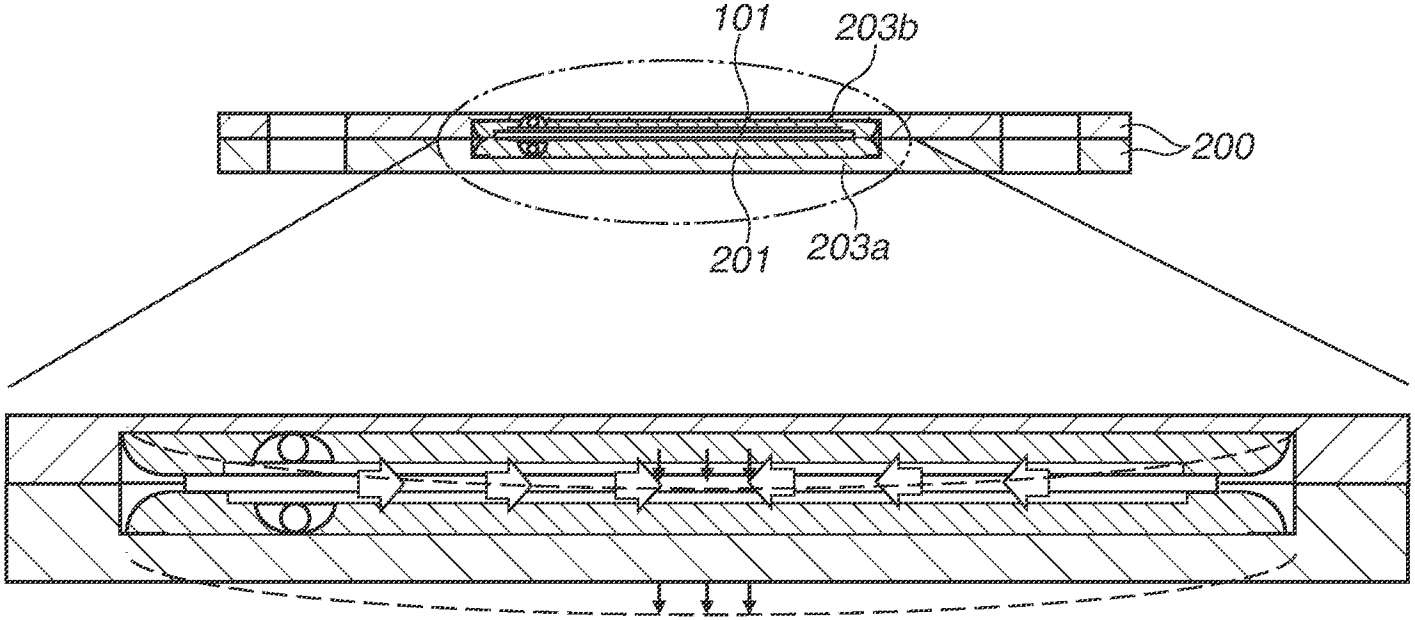
FIG. 7B is a schematic diagram illustrating behavior of the diaphragm when the piezoelectric element contracts.

FIGS. 7A and 7B are diaphragms schematically illustrating behavior of the diaphragm when the piezoelectric element 101 expands/contracts. When an alternating voltage is applied to the piezoelectric element 101 of the piezoelectric actuator, the piezoelectric element 101 repeats expansion and contraction in accordance with a frequency. The diaphragm pump 1 changes volumes of the first pump chamber and the second pump chamber with deformation of the diaphragm due to expansion and contraction of the piezoelectric element 101, and thereby causes fluid to flow. The operation of the diaphragm pump 1 including the first pump 2 and the second pump 3 and the fluid flow are now to be described.

First, a description is given of a case where the piezoelectric element 101 expands. The piezoelectric element 101 is capable of expanding, while the first diaphragm 203*a* and the second diaphragm 203*b* that are bonded to the actuator 100 are not capable of expanding. Hence, the first diaphragm 203*a* and the second diaphragm 203*b* are pulled by the piezoelectric element 101 and deformed. In the present exemplary embodiment, the first diaphragm 203*a* and the second diaphragm 203*b* have different thicknesses of 0.5 mm and 0.3 mm, respectively, and thus are different in stiffness. That is, the second diaphragm 203*b* is more susceptible to deformation, and the first diaphragm 203*a* is less susceptible to deformation.

Hence, when the piezoelectric element 101 expands, the diaphragm is displaced in a direction in which the second diaphragm 203*b* is more easily deformed than the first diaphragm 203*a*, that is, a direction to the second pump chamber 301*b*. At this time, the first pump chamber 301*a* expands and the second pump chamber 301*b* contracts.

Figure 8:
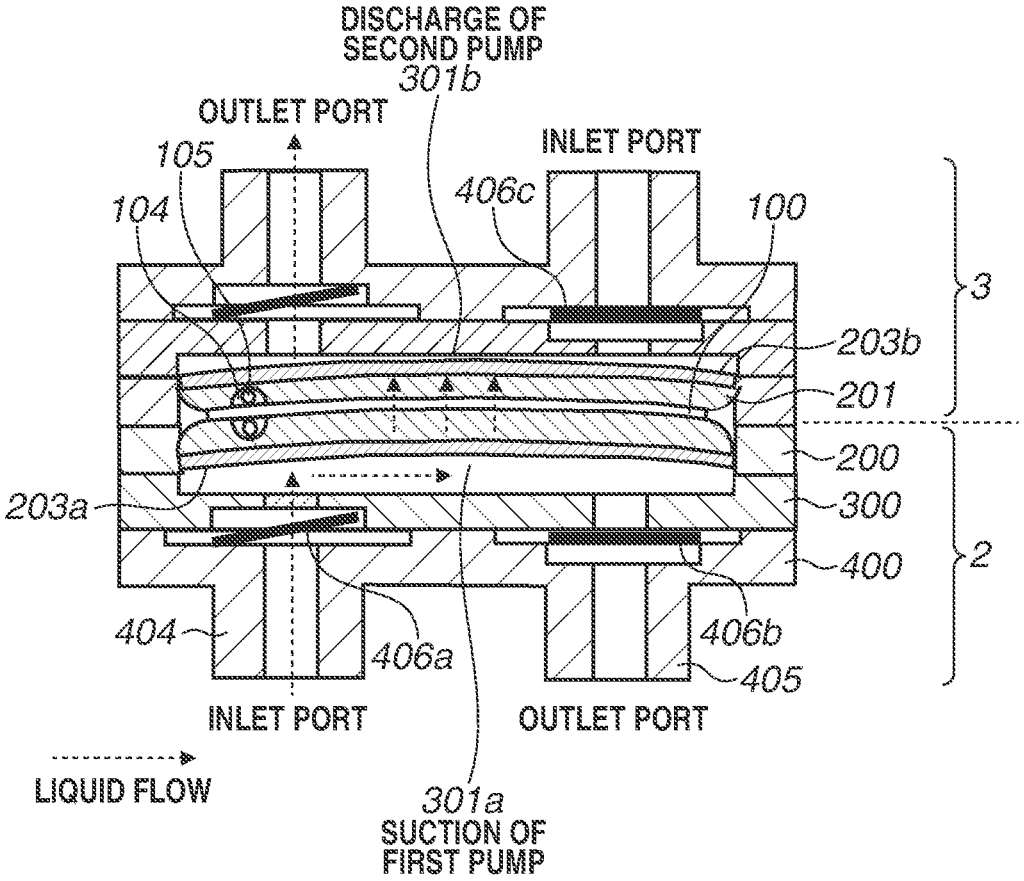
FIG. 8 is a schematic diagram illustrating a fluid flow when the diaphragm curves toward a second pump chamber side.

FIG. 8 is a schematic diagram illustrating the fluid flow when the diaphragm curves toward the second pump chamber 301*b*. First, the fluid flow inside the first pump 2 is to be described. When the first pump chamber 301*a* expands and the second pump chamber 301*b* contracts, pressure inside the first pump chamber 301*a* decreases. With this configuration, the first check valve 406*a* that closes the first inlet port opens, and the check valve 406*b* that closes the first outlet port does not open. Hence, fluid flows from the first inlet port into the first pump chamber 301*a*, and fluid does not flow out of the first outlet port.

The fluid flow inside the second pump 3 is to be described. When the first pump chamber 301*a* expands and the second pump chamber 301*b* contracts, pressure inside the second pump chamber 301*b* increases. With this configuration, a fourth check valve 406*d* that closes the second outlet port opens, and a third check valve 406*c* that closes the second outlet port does not open. Hence, fluid passes through the second outlet port and flows out of the second pump chamber 301*b*, and fluid does not flow into the second pump chamber 301*b* through the second inlet port.

With this configuration, when the diaphragm is displaced convexly in the direction to the second pump chamber 301*b*, the first pump chamber 301*a* expands and the second pump chamber 301*b* contracts, so that fluid flows into the first pump chamber 301*a* and fluid flows out of the second pump chamber 301*b*.

A description is given of a case where the piezoelectric element 101 contracts in a manner like a state illustrated in FIG. 7A to a state illustrated in FIG. 7B. The piezoelectric element 101 is capable of contracting, while the first diaphragm 203*a* and the second diaphragm 203*b* that are bonded to the actuator 100 are not capable of contracting. Hence, also in a case where the piezoelectric element 101 contracts, similarly to the case where the piezoelectric element 101 expands, the first diaphragm 203*a* and the second diaphragm 203*b* are pulled by the piezoelectric element 101 and deformed. In the present exemplary embodiment, the first diaphragm 203*a* is larger in thickness and higher in stiffness than the second diaphragm 203*b*, but inertia acts on both the first diaphragm 203*a* and the second diaphragm 203*b* when the piezoelectric element 101 shifts from the state illustrated in FIG. 7A to the state illustrated in FIG. 7B. Thus, the diaphragm is displaced convexly toward the second pump chamber 301*b* when the piezoelectric element 101 expands for the first time, while the piezoelectric element 101 contracts convexly in a direction to the first pump chamber 301*a* when the piezoelectric element 101 contracts for the second time. At this time, the second pump chamber 301*b* expands and the first pump chamber 301*a* contracts.

Figure 9:
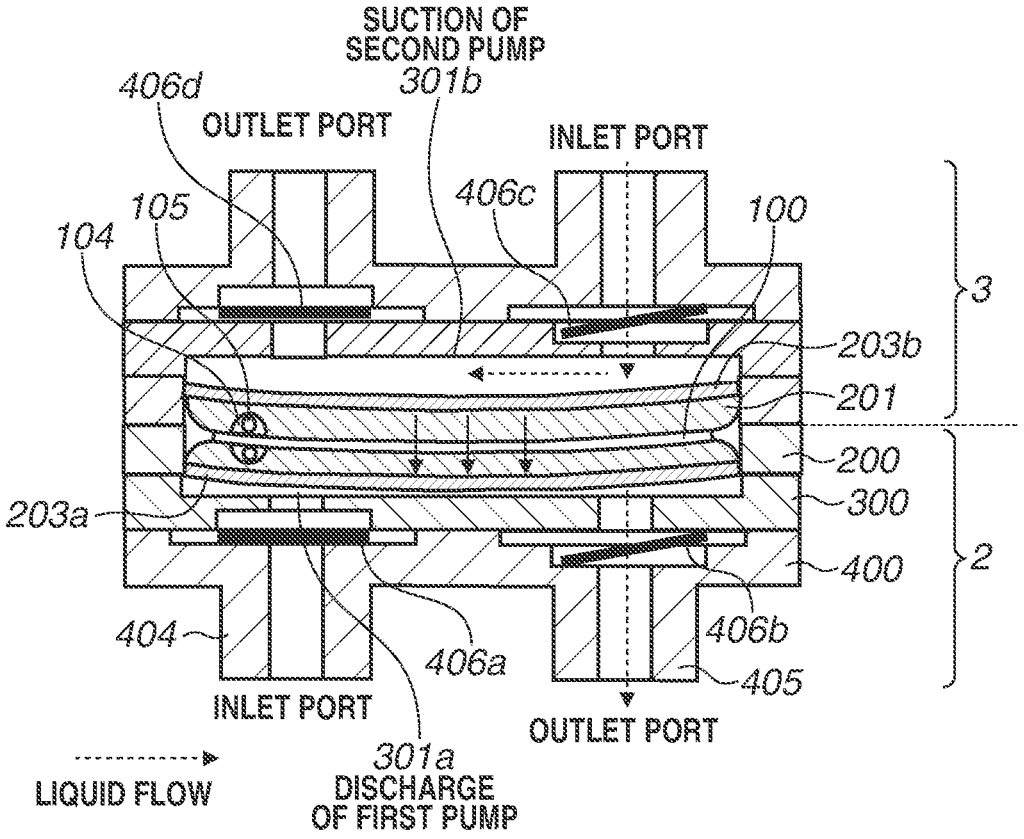
FIG. 9 is a schematic diagram illustrating a fluid flow when the diaphragm curves toward a first pump chamber side.

FIG. 9 is a schematic diagram illustrating the fluid flow when the diaphragm curves toward the first pump chamber 301*a*. First, the fluid flow inside the first pump 2 is to be described. When the second pump chamber 301*b* expands and the first pump chamber 301*a* contracts, pressure inside the first pump chamber 301*a* increases. With this configuration, the first check valve 406*a* that opens the first inlet port closes, and the second check valve 406*b* that closes the first outlet port opens. Hence, an inflow of fluid from the first inlet port to the first pump chamber 301*a* is interrupted, and fluid inside the first pump chamber 301*a* flows out of the first outlet port.

The fluid flow inside the second pump 3 is now to be described. When the second pump chamber 301*b* expands and the first pump chamber 301*a* contracts, pressure inside the second pump chamber 301*b* decreases. With this configuration, the third check valve 406*c* that closes the second inlet port opens, and the fourth check valve 406*d* that closes the second outlet port closes. Hence, fluid passes through the second inlet port and flows into the second pump chamber 301*b*, and the outflow of fluid inside the second pump chamber 301*b* from the second outlet port is interrupted.

With this configuration, when the diaphragm is displaced convexly in the direction to the first pump chamber 301*a*, the second pump chamber 301*b* expands and the first pump chamber 301*a* contracts, so that fluid flows into the second pump chamber 301*b* and fluid flow out of the first pump chamber 301*a*.

Figure 10:
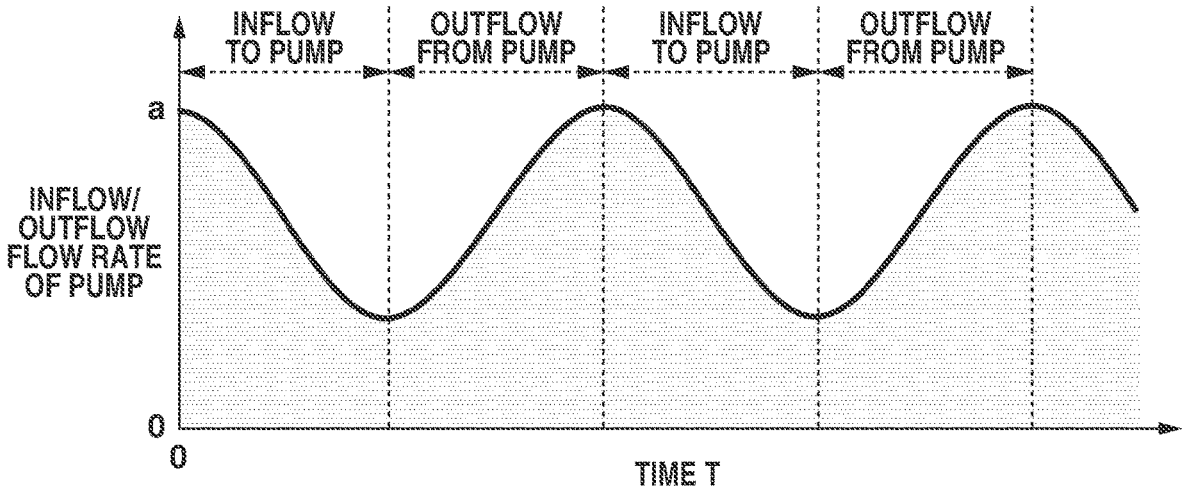
FIG. 10 is a relationship diagram illustrating a relationship between an outflow flow rate and time when the first pump is used alone.

A relationship between the flow rate of fluid that flows out of the diaphragm pump 1 to a liquid supply destination and time is to be described. First, FIG. 10 is a diagram illustrating a relationship between an outflow flow rate and time when the first pump 2 is used alone. As described above, assuming that the first pump 2 is used alone, when the first diaphragm 203*a* is displaced convexly in a direction in which the first pump chamber 301*a* expands, the first check valve 406*a* that opens/closes the first inlet port opens and the second check valve 406*b* that opens/closes the first outlet port closes. In contrast, when the first diaphragm 203*a* is displaced convexly in a direction in which the first pump chamber 301*a* contracts, the first check valve 406*a* that opens/closes the first inlet port closes and the second check valve 406*b* that opens/closes the first outlet port opens. Hence, the outflow of fluid is interrupted when fluid flows into the first pump 2, and the inflow of fluid is interrupted when fluid flows out of the first pump 2. Thus, as illustrated in FIG. 10, the flow rate of fluid that flows out of the first pump 2 fluctuates.

Figure 11:
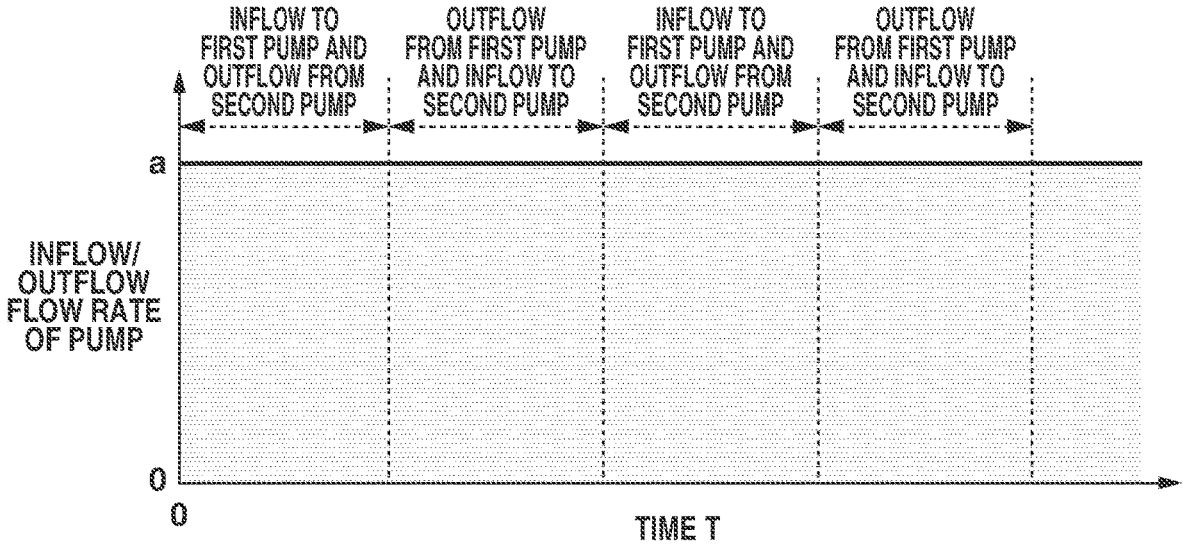
FIG. 11 is a relationship diagram illustrating a relationship between an outflow flow rate and time in the diaphragm pump according to the present disclosure.

FIG. 11 is a relationship diagram illustrating a relationship between an outflow flow rate and time in the diaphragm pump 1 according to the present disclosure. As described above, when the diaphragm is displaced convexly in the direction to the second pump chamber 301*b*, the first pump chamber 301*a* expands and the second pump chamber 301*b* contracts, so that fluid does not flow out of the first pump chamber 301*a* and fluid flows out of the second pump chamber 301*b*. In contrast, when the diaphragm is displaced convexly in the direction to the first pump chamber 301*a*, the second pump chamber 301*b* expands and the first pump chamber 301*a* contracts, so that fluid does not flow out of the second pump chamber 301*b* and fluid flows out of the first pump chamber 301*a*. Hence, when the piezoelectric element 101 expands/contracts, fluid flows out of either the first pump 2 or the second pump 3. In other words, in the diaphragm pump 1 according to the present disclosure, because the outflow flow rate does not change with the elapse of time as illustrated in FIG. 11, there is no need for arranging a plurality of actuators, and pulsation of fluid supplied from the diaphragm pump 1 can be reduced with a relatively simple configuration.

(Connection Destination of Diaphragm Pump)

Figure 12:
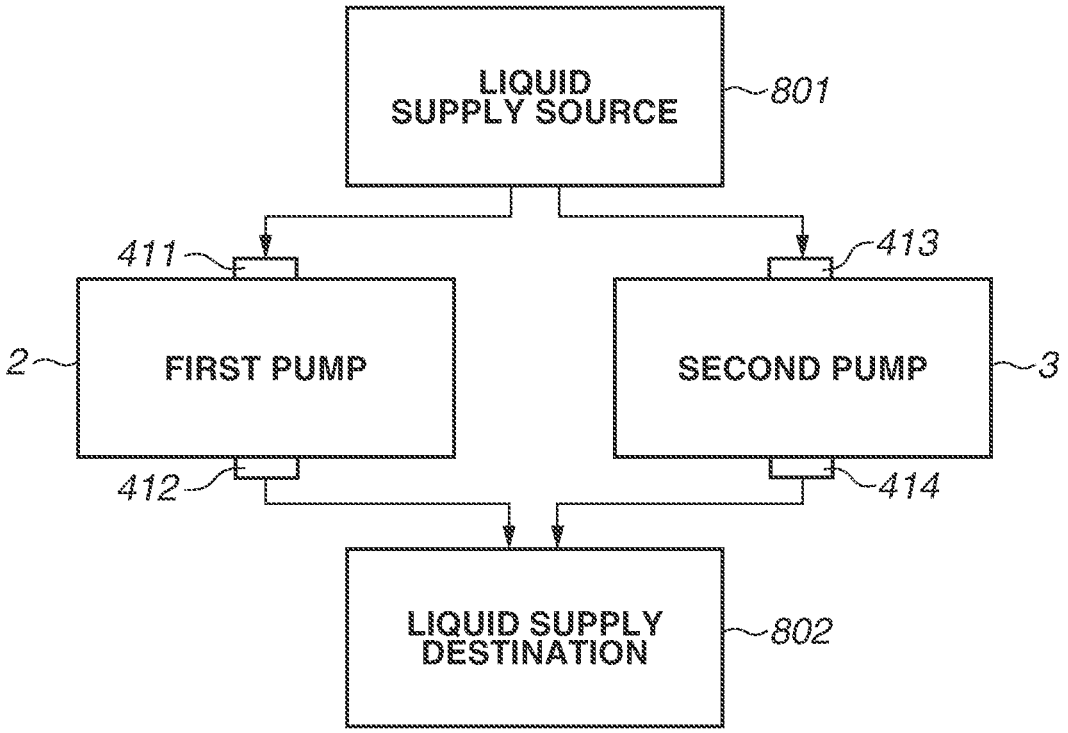
FIG. 12 is a diagram schematically illustrating pipe connection of the diaphragm pump.

A description is given of how the first pump 2 and the second pump 3 are connected to a liquid supply source and a liquid supply destination. FIG. 12 is a schematic diagram illustrating a pipe arrangement configuration of the diaphragm pump 1 according to the exemplary embodiment of the present disclosure. For simplicity of description about pipe arrangement, a description is given using a configuration in which the first pump 2 and the second pump 3 are separately arranged. A liquid supply source 801 is connected to the first pump 2 and the second pump 3 via a first inlet port 411 and a second inlet port 413, respectively. That is, fluid flows into the first pump 2 and the second pump 3 from the liquid supply source 801 via the first inlet port 411 and the second inlet port 413, respectively. A first outlet port 412 and a second outlet port 414 are connected to a liquid supply destination 802. That is, fluid flows out of the first pump 2 and the second pump 3 to the liquid supply destination 802 via the first outlet port 412 and the second outlet port 414, respectively.

Figure 13:
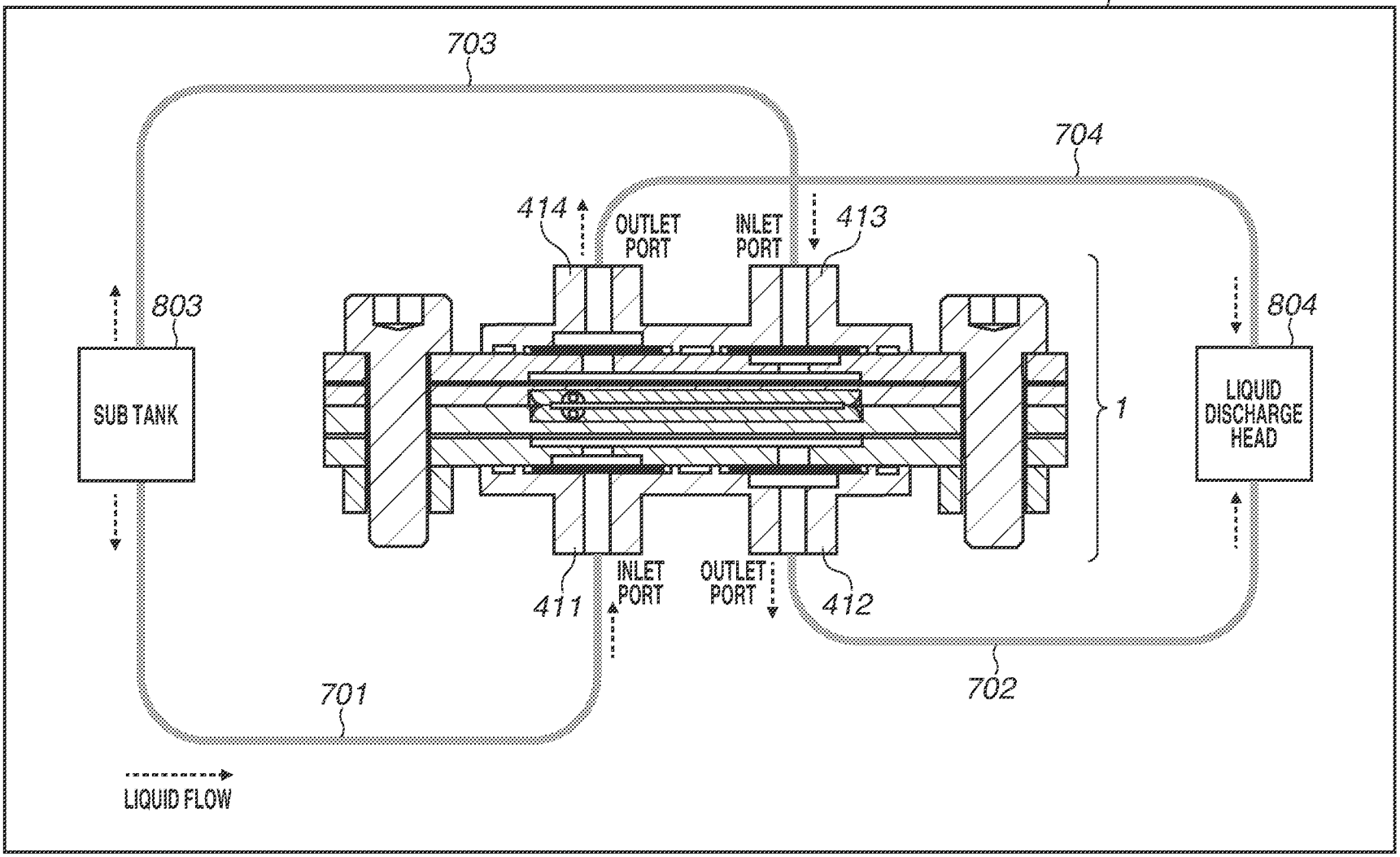
FIG. 13 is a diagram schematically illustrating pipe connection when the diaphragm pump is connected to a liquid discharge apparatus.

FIG. 13 is a diagram schematically illustrating pipe connection when the diaphragm pump 1 is connected to a liquid discharge apparatus 800. In FIG. 13, a liquid supply source is a sub tank (liquid reservoir) 803, and a liquid supply destination is a liquid discharge head 804 for discharging liquid. In FIG. 13, the liquid discharge apparatus 800 includes the liquid discharge head 804 and the liquid reservoir 803 inside a housing 805, but the liquid reservoir 803 may be arranged inside or outside the housing 805. The diaphragm pump 1 according to the present disclosure is arranged outside the liquid discharge head 804 and inside the housing 805.

The diaphragm pump 1 is connected to the liquid reservoir 803 and the liquid discharge head 804.

Specifically, the liquid discharge apparatus 800 includes a first inflow channel 701 that connects the first inlet port 411 and the liquid reservoir 803, and a second inflow channel 703 that connects the second inlet port 413 and the liquid reservoir 803. That is, fluid in the liquid reservoir 803 flows into the first pump 2 and the second pump 3 via the first inflow channel 701 and the second inflow channel 703, respectively. Liquid that flows out of the first pump 2 and the second pump 3 is supplied to the liquid discharge head 804 via a first outflow channel 702 and a second outflow channel 704, respectively.

With arrangement of the diaphragm pump 1 in the liquid discharge apparatus 800, it is possible to reduce pulsation, which is caused by pumping, in liquid supplied to the liquid discharge head 804.

Figure 14:
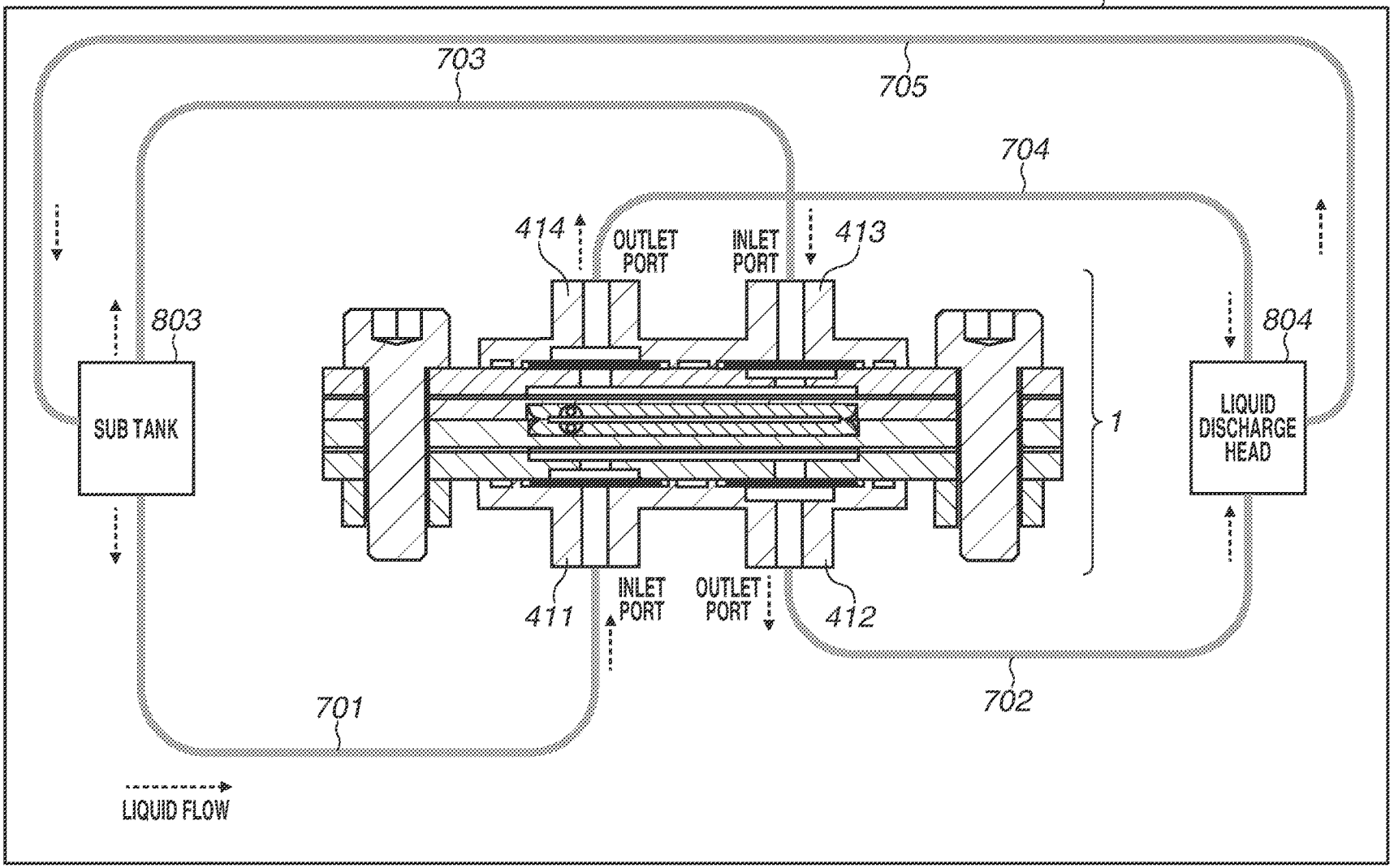
FIG. 14 is a diagram schematically illustrating pipe connection when the diaphragm pump is connected to a circulation-type liquid discharge apparatus.

FIG. 14 is a diagram schematically illustrating pipe connection when the diaphragm pump 1 according to the present disclosure is connected to the circulation-type liquid discharge apparatus 800. A difference between the configuration illustrated in FIG. 14 and the configuration illustrated in FIG. 13 is that a collecting channel 705 for collecting liquid that is not discharged from the liquid discharge head 804 is arranged in FIG. 14. With this configuration, liquid that is not discharged from the liquid discharge head 804 passes through the collecting channel 705, and flows into the diaphragm pump 1 again.

Circulation of liquid in the liquid discharge apparatus 800 can reduce thickening of liquid and prevent sedimentation of pigments included in ink. Circulation of liquid in a region in the vicinity of a discharge orifice from which liquid is discharged (pressure chamber or the like) can reduce defective discharge.

In FIG. 14, one end of the collecting channel 705 is connected to the liquid discharge head 804, and the other end of the collecting channel 705 is connected to the liquid reservoir 803, but a connection destination of the other end is not limited to the liquid reservoir 803. That is, assuming that the liquid discharge head 804 is on the downstream side, the other end of the collecting channel 705 is only required to be connected on the upstream side of the diaphragm pump 1. For example, the other end of the collecting channel 705 may be connected to the first inflow channel 701 or the second inflow channel 703.

The liquid discharge apparatus 800 may include a liquid discharge head unit that is provided with the liquid discharge head 804 for discharging liquid and that includes the diaphragm pump 1. That is, the liquid discharge head 804 and the diaphragm pump 1 may have an integrated configuration to form the liquid discharge unit. Such a configuration can shorten a distance between the liquid discharge head 804 and the diaphragm pump 1, and allows liquid to effectively circulate. In a case where a conventional diaphragm pump and the liquid discharge head 804 are integrated with each other, there is a need for arranging a pressure regulatory mechanism to prevent fluctuations in liquid supply quantity. In contrast, the diaphragm pump 1 according to the present disclosure is capable of preventing fluctuations in liquid supply quantity without arrangement of the pressure regulatory mechanism as described above. This configuration can downsize the liquid discharging head unit in which the diaphragm pump 1 and the liquid discharge head 804 are integrated with each other. Thus, the present disclosure is preferable for a liquid discharge apparatus in which a diaphragm pump and a liquid discharge head are integrated with each other.

As described above, the diaphragm pump according to the present disclosure enables downsizing of the liquid discharge head unit, and thus is more preferable for a so-called serial-type liquid discharge apparatus that includes a mounting unit (carriage) on which the liquid discharge head unit is mounted. The mounting unit reciprocally moves with respect to a recording medium.

According to the above-mentioned configuration, in the diaphragm pump of the present disclosure, fluid flows out of either the first pump 2 or the second pump 3 when the piezoelectric element 101 expands/contracts. Thus, the present disclosure can reduce pulsation of fluid supplied from the diaphragm pump with a relatively simple configuration without arrangement of a plurality of actuators.

A configuration of a diaphragm pump according to a second exemplary embodiment of the present disclosure is now to be described. The following description is given mainly of points different from the first exemplary embodiment, and a description of matters similar to those of the first exemplary embodiment is omitted.

Figure 15:
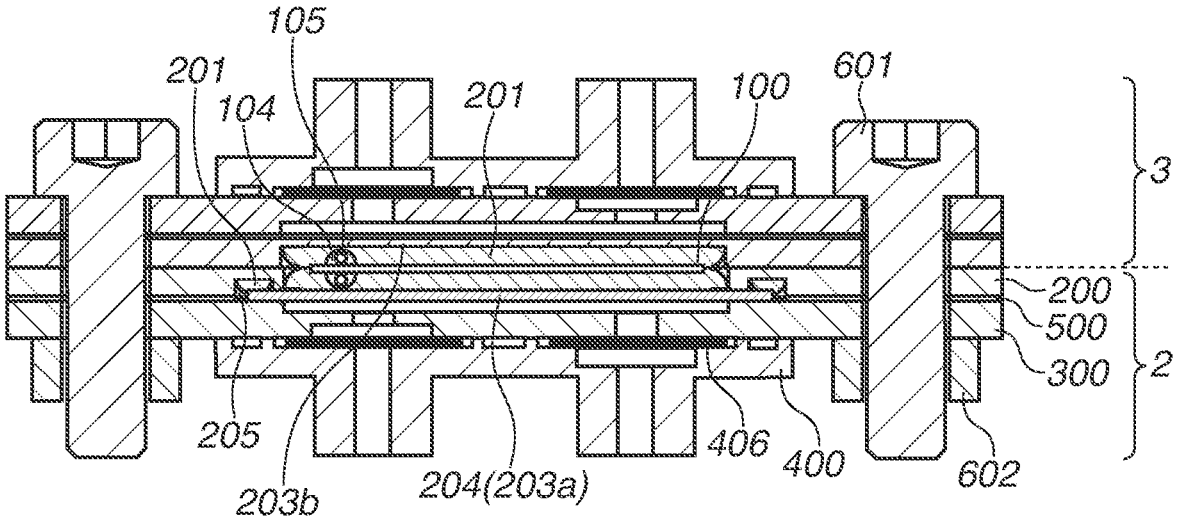
FIG. 15 is a cross-sectional view illustrating a diaphragm pump according to a second exemplary embodiment.

FIG. 15 illustrates a configuration of the diaphragm pump according to the second exemplary embodiment. In the first exemplary embodiment, the first diaphragm 203*a* and the second diaphragm 203*b* are different in stiffness because the thickness of the first diaphragm 203*a* and that of the second diaphragm 203*b* are different.

In contrast, in the second exemplary embodiment, the thickness of the first diaphragm 203*a* and that of the second diaphragm 203*b* are substantially identical, and the first diaphragm 203*a* and the second diaphragm 203*b* are different in stiffness because a material of the first diaphragm

203*a* and that of the second diaphragm 203*b* are different. In the second exemplary embodiment, a metal plate with a thickness of 0.2 mm is used as the first diaphragm 203*a*, and a resin plate with a thickness of 0.2 mm is used as the second diaphragm 203*b*. As described above, when the first diaphragm 203*a* and that of the second diaphragm 203*b* are different in stiffness, the diaphragm can be displaced convexly in a predetermined direction along with expansion/contraction of the piezoelectric element 101. However, when stiffness of the first diaphragm is too high, the displacement of the diaphragm along with the expansion/contraction of the piezoelectric element 101 becomes small, leading to a decrease in liquid outflow efficiency of the diaphragm pump 1. Thus, a brass plate 204 is preferable as the metal plate. The brass plate 204 is preferable as the metal plate because the brass plate 204 has a vertical elastic coefficient of 100 gigapascals (GPa), while a resin material has a vertical elastic coefficient of about 10 GPa or less, although depending on a material. In other words, as a combination of the metal plate and the resin material, it is preferable to adopt the metal plate having stiffness that is not too high, and the resin material having stiffness of such a degree as that satisfies stiffness of the diaphragm. The brass plate 204 is bonded and fixed by the adhesive 201 that fills a brass plate adhesion groove 205 arranged in the diaphragm body 200.

A mode that combines the configurations of the above-mentioned exemplary embodiments can be applied as appropriate. In summary, the present disclosure includes the following configuration.

The present disclosure enables provision of the diaphragm pump that reduces pulsation of fluid to be supplied with the relatively simple configuration and the liquid discharge apparatus including the diaphragm pump.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-120157, filed Jul. 28, 2022, which is hereby incorporated by reference herein in its entirety.

What is claimed is:

1. A diaphragm pump comprising:

an actuator including a first surface and a second surface that is a back surface of the first surface;

a first diaphragm bonded to the first surface and a second diaphragm bonded to the second surface;

a first pump chamber that faces the first diaphragm, and that is formed on a side of the first surface; and a second pump chamber that faces the second diaphragm, and that is formed on a side of the second surface, wherein the diaphragm pump is configured to deform to change a volume of the first pump chamber and a volume of the second pump chamber so that fluid flows, wherein, when the first diaphragm and the second diaphragm are displaced convexly in a direction to the first pump chamber, the second pump chamber is configured to expand and the first pump chamber is configured to contract so that fluid flows into the second pump chamber and fluid flows out of the first pump chamber, wherein, when the first diaphragm and the second diaphragm are displaced convexly in a direction to the second pump chamber, the first pump chamber is configured to expand and the second pump chamber is configured to contract so that fluid flows into the first pump chamber and fluid flows out of the second pump chamber, and wherein the first diaphragm and the second diaphragm are different in stiffness.

2. The diaphragm pump according to claim 1, further comprising:

a first inlet port through which flowing fluid flows into the first pump chamber;

a first outlet port through which flowing fluid flows out of the first pump chamber;

a second inlet port through which flowing fluid flows into the second pump chamber; and a second outlet port through which flowing fluid flows out of the second pump chamber.

3. The diaphragm pump according to claim 2, further comprising:

a first check valve configured to open/close the first inlet port;

a second check valve configured to open/close the first outlet port;

a third check valve configured to open/close the second inlet port; and a fourth check valve configured to open/close the second outlet port.

4. The diaphragm pump according to claim 3, wherein, when the first diaphragm and the second diaphragm are displaced convexly in the direction to the first pump chamber, the second check valve is configured to open the first outlet port, the third check valve is configured to open the second inlet port, the first check valve is configured to close the first inlet port, and the fourth check valve is configured to close the second outlet port, and wherein, when the first diaphragm and the second diaphragm are displaced convexly in the direction to the second pump chamber, the first check valve is configured to open the first inlet port, the fourth check valve is configured to open the second outlet port, the second check valve is configured to close the first outlet port, and the third check valve is configured to close the second inlet port.

5. The diaphragm pump according to claim 2, wherein the first inlet port and the second outlet port are formed at opposing positions across the actuator and the first outlet port and the second inlet port are formed at opposing positions across the actuator.

6. The diaphragm pump according to claim 1, wherein the first diaphragm and the second of diaphragm are different in thickness.

7. The diaphragm pump according to claim 1, wherein the first diaphragm and the second diaphragm are different in material.

8. The diaphragm pump according to claim 7, wherein the first diaphragm is made of a metal plate and the second diaphragm is made of a resin plate.

9. The diaphragm pump according to claim 8, wherein the first diaphragm is made of a brass plate.

10. The diaphragm pump according to claim 1, wherein the actuator is a piezoelectric actuator.

11. A liquid discharge apparatus comprising:

a liquid discharge head configured to discharge liquid;

a housing configured to house the liquid discharge head inside;

a liquid reservoir container configured to reserve liquid; and a diaphragm pump that is arranged outside the liquid discharge head and inside the housing, wherein the diaphragm pump includes:

an actuator including a first surface and a second surface that is a back surface of the first surface, a first diaphragm bonded to the first surface and a second diaphragm bonded to the second surface, a first pump chamber that faces the first diaphragm, and that is formed on a side of the first surface, a second pump chamber that faces the second diaphragm, and that is formed on a side of the second surface, a first inlet port through which flowing fluid flows into the first pump chamber, a first outlet port through which flowing fluid flows out of the first pump chamber, a second inlet port through which flowing fluid flows into the second pump chamber, and a second outlet port through which flowing fluid flows out of the second pump chamber, wherein the diaphragm pump is configured to deform to change a volume of the first pump chamber and a volume of the second pump chamber so that fluid flows, wherein, when the first diaphragm and the second diaphragm are displaced convexly in a direction to the first pump chamber, the second pump chamber is configured to expand and the first pump chamber is configured to contract so that fluid flows into the second pump chamber and fluid flows out of the first pump chamber, wherein, when the first diaphragm and the second diaphragm are displaced convexly in a direction to the second pump chamber, the first pump chamber is configured to expand and the second pump chamber is configured to contract so that fluid flows into the first pump chamber and fluid flows out of the second pump chamber, and wherein the first diaphragm and the second diaphragm are different in stiffness.

12. The liquid discharge apparatus according to claim 11, further comprising:

a first inflow channel configured to connect the first inlet port and the liquid reservoir container;

a second inflow channel configured to connect the second inlet port and the liquid reservoir container;

a first outlet port through which flowing liquid flows out of the first outlet port to the liquid discharge head; and a second outlet port through which flowing liquid flows out of the second outlet port to the liquid discharge head.

13. The liquid discharge apparatus according to claim 12, further comprising a collecting channel through which liquid that is not discharged from the liquid discharge head is collected.

14. A liquid discharge apparatus comprising:

a liquid discharge head unit including a liquid discharge head configured to discharge liquid, wherein the liquid discharge head includes a diaphragm pump, wherein the diaphragm pump includes:

an actuator including a first surface and a second surface that is a back surface of the first surface, a first diaphragm bonded to the first surface and a second diaphragm bonded to the second surface, a first pump chamber that faces the first diaphragm, and that is formed on a side of the first surface, a second pump chamber that faces the second diaphragm, and that is formed on a side of the second surface, a first inlet port through which flowing fluid flows into the first pump chamber, a first outlet port through which flowing fluid flows out of the first pump chamber, a second inlet port through which flowing fluid flows into the second pump chamber, and a second outlet port through which flowing fluid flows out of the second pump chamber, wherein the diaphragm pump is configured to deform to change a volume of the first pump chamber and a volume of the second pump chamber so that fluid flows, wherein, when the first diaphragm and the second diaphragm are displaced convexly in a direction to the first pump chamber, the second pump chamber is configured to expand and the first pump chamber is configured to contract so that fluid flows into the second pump chamber and fluid flows out of the first pump chamber, wherein, when the first diaphragm and the second diaphragm are displaced convexly in a direction to the second pump chamber, the first pump chamber is configured to expand and the second pump chamber is configured to contract so that fluid flows into the first pump chamber and fluid flows out of the second pump chamber, and wherein flowing liquid flows out of the first outlet port and the second outlet port to the liquid discharge head and flowing liquid flows from the liquid discharge head into the first inlet port and the second inlet port.

15. The liquid discharge apparatus according to claim 14, further comprising a mounting unit on which the liquid discharge head unit is mounted, wherein the mounting unit is configured to reciprocally move with respect to a recording medium.

* * * * *